United States Patent [19]

Fankhauser et al.

[11] 4,261,867

[45] Apr. 14, 1981

[54] USING
1-ETHYNYL-2,2,6-TRIMETHYL-CYCLOHEXANOL TO ENHANCE WOODY FRAGRANCE OF PERFUME COMPOSITIONS

[75] Inventors: Peter Fankhauser, Onex; Anthony F. Morris, Gingins, both of Switzerland

[73] Assignee: Firmenich, S.A., Geneva, Switzerland

[21] Appl. No.: 116,767

[22] Filed: Jan. 30, 1980

[30] Foreign Application Priority Data

Feb. 2, 1979 [CH] Switzerland ..... 1087/79

[51] Int. Cl.[3] ..... C11B 9/00

[52] U.S. Cl. ..... 252/522 R; 426/538; 252/174.17; 131/303

[58] Field of Search ..... 252/522 R

[56] References Cited

FOREIGN PATENT DOCUMENTS 2444585 4/1976 Fed. Rep. of Germany .

OTHER PUBLICATIONS

J. Attenburrow et al., J. Chem. Soc., pp. 1094–1111, 1952.

*Primary Examiner*—Veronica O'Keefe
*Attorney, Agent, or Firm*—Scully, Scott, Murphy & Presser

[57] ABSTRACT

1-Ethynyl-2,2-6-trimethyl-cyclohexanol, a compound of formula

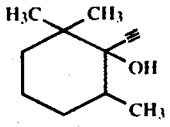

possesses useful perfuming and flavoring properties. Use of said hydroxy-acetylenic derivative as perfume and flavor ingredient is discussed.

4 Claims, No Drawings

USING 1-ETHYNYL-2,2,6-TRIMETHYL-CYCLOHEXANOL TO ENHANCE WOODY FRAGRANCE OF PERFUME COMPOSITIONS

BACKGROUND OF THE INVENTION

In a constant endeavour towards the further enrichment of the fragrances palette which the perfumer has at his disposal for his creation and reconstitution activity, the chemical industry has spent much effort directed to the synthesis of new compounds possessing interesting odorous properties.

Thus DE-OS No. 24 44 585 describes the synthesis of a compound of formula

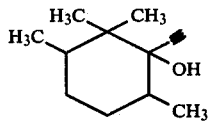

which develops a pleasant camphery odour.

THE INVENTION

We have now surprisingly discovered that a lower homologue of the above described compound, viz. 1-ethynyl-2,2,6-trimethyl-cyclohexanol of formula

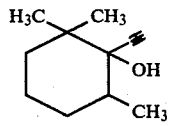

develops unexpectedly perfuming properties which considerably differ from those developed by the said described compound. 1-Ethynyl-2,2,6-trimethyl-cyclohexanol possesses woody and earthy odorous characters; its fragrance, though showing a slightly camphery nuance in much the same extent as its higher homologue, does not show the aggressiveness of 1-ethynyl-2,2,3,6-tetramethyl-cyclohexanol and consequently 1-ethynyl-2,2,6-trimethyl-cyclohexanol, contrary to the cited homologue, can confer to the perfume compositions into which it is incorporated a distinct elegance and a particular fineness.

Moreover, 1-ethynyl-2,2,6-trimethyl-cyclohexanol possesses useful flavouring properties. It develops in fact woody and earthy flavour notes and its character is reminiscent of patchouli oil, consequently it can be used for the aromatization of various products ranging from smoking tobacco to beverages such as infusions or decoctions, tea for instance. The present invention relates to a process for enhancing, improving or modifying the fragrance properties of perfumes and perfumed products which process comprises the step of admixing 1-ethynyl-2,2,6-trimethyl-cyclohexanol in said perfumes or perfumed products.

More particularly, the instant invention provides a process for enhancing, improving or modifying the woody scent of perfume compositions which comprises adding thereto a fragrance effective amount of 1-ethynyl-2,2,6-trimethyl-cyclohexanol.

This invention relates also to a perfume composition which comprises as an effective fragrance-modifying ingredient 1-ethynyl-2,2,6-trimethyl-cyclohexanol.

Finally, an object of this invention is to provide a flavour composition which comprises as active ingredient 1-ethynyl-2,2,6-trimethyl-cyclohexanol.

PREFERRED EMBODIMENTS OF THE INVENTION

Owing to its organoleptic properties 1-ethynyl-2,2,6-trimethyl-cyclohexanol can find an utilization in various compositions of different nature. It can be successfully used in combination with other odorous ingredients, namely in compositions of woody, lavender, fougere or spicy type wherein it increases their freshness, their diffusiveness and their strength. More particularly, 1-ethynyl-2,2,6-trimethyl-cyclohexanol can be used as reinforcer of patchouli essential oil, a basic natural perfumery ingredient. In perfumery, the concentrations at which the said compound can be used to promote the described effects can vary within a wide range. Thus, concentrations of the order of about 0.1% by weight, based on the weight of the perfume composition into which it is added, can already achieve satisfactory results. The concentration however can be increased beyond this value whenever special effects are desired.

In the field of flavours, interesting effects can be obtained by using the compound in question in concentrations of about 0.5 to 0.1 ppm (parts per million) by weight based on the total weight of the materials into which it is incorporated.

In this case too, the said values are not deemed to be interpreted restrictively and concentrations higher or lower than the above given limits may equally apply in certain circumstances.

1-Ethynyl-2,2,6-trimethyl-cyclohexanol is a compound of known structure, namely it has been described by J. Attenburrow et al., in J. Chem. Soc. 1952, 1094–1111, as an intermediate in the process for the preparation of vitamine A; hitherto however its organoleptic properties have not been described and a fortiori its utility in the perfumery and flavour field has not been recognized.

The synthesis of 1-ethynyl-2,2,6-trimethylcyclohexanol can be effected by ethynylation of trimethylcyclohexanone, for example by following the procedure given by W. Ziegenbein, "Aethinylierung und Alkinylierung", p. 9, Verlag-Chemie (1963). According to the said procedure, the desired compound is obtained under the form of an isomeric mixture of compounds of formula

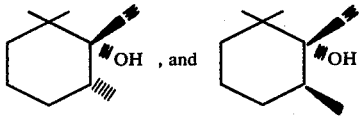

cis trans respectively, in a weight ratio of about 17:83.

By fractional distillation it was however possible to separate the two isomers in practically pure state. Their respective analytical characters were as follows:

trans-isomer

NMR ($CDCl_3$; 360 MHz): 1.01, 1.13 (6H, 2s); 1.05 (3H, d, J=6 Hz); 1.30–1.70 (6H, m); 1.88 (1H, m); 2.50 (1H, s) δ ppm;

MS:$M^{+\cdot}$=166 (4); m/e: 151 (18), 137 (4), 133 (12), 125 (37), 123 (21), 110 (46), 109 (34), 95 (71), 82 (100), 81

(38), 69 (29), 67 (24), 55 (39), 53 (32), 43 (40), 41 (55), 27 (20).

cis-isomer

NMR ($CDCl_3$; 360 MHz): 1.10–1.11 (6H, 2s); 1.08 (3H, d, J=6 Hz); 1.20–1.70 (6H, m); 1.91 (1H, m); 2.43 (1H, s) δ ppm;

MS: identical to that of the trans-isomer.

Though the two isomers possess a rather similar odorous note, the trans-isomer develops a more elegant and more powerful scent that its cis derivative.

The invention is better illustrated by but not limited to the following examples.

EXAMPLE 1

A base perfume composition of woody type was prepared by mixing together the following ingredients (parts by weight):

| | |
|---|---|
| Trimethylcyclododecatriene-monoepoxyde[1] | 200 |
| Cetyver[2] | 200 |
| p-tert-Butylcyclohexanyl acetate | 200 |
| Patchouli oil | 200 |
| Sandal wood oil | 200 |
| | 1000 |

[1]Origin: Firmenich SA. see e.g. Swiss Pat. No. 474,567
[2]Origin: perfume base of Firmenich SA. Genève.

By adding to 99.8 g of the above perfume base, 0.2 g of 1-ethynyl-2,2,6-trimethyl-cyclohexanol there was obtained a novel composition wherein the character of patchouli oil type was more marked than that of the base, it possessed moreover an improved diffusiveness and an increased strength.

EXAMPLE 2

A commercial grade soap paste was perfumed by adding thereto 0.1% by weight of 1-ethynyl-2,2,6-trimethyl-cyclohexanol. The thus obtained perfumed paste was used to manufacture toilet soap bars and their fragrance was then evaluated by comparison with non perfumed bars. The testers found that the perfumed bars possessed an agreable and elegant scent.

EXAMPLE 3

A base perfume composition of "fougère" type was obtained by mixing together the following ingredients (parts by weight):

| | |
|---|---|
| Amyl salicylate | 150 |
| Trimethylcyclododecatriene-epoxyde[1] | 100 |
| Coumarin | 150 |
| Eugenol | 50 |
| Iso-bornyl acetate | 100 |
| Lavandin oil | 425 |
| Absolute oak-moss 50%* | 25 |
| | 1000 |

*in diethyl phthalate
[1]see Example 1

By adding to 98 g of the base composition given above, 2 g of 1-ethynyl-2,2,6-trimethyl-cyclohexanol there was obtained a novel composition whose odorous character was fresher than that of the base. Its fragrance moreover possessed a more marked herbaceous and woody (dry wood) character and showed a better diffusiveness.

EXAMPLE 4

1-Ethynyl-2,2,6-trimethyl-cyclohexanol was subjected to a gustative evaluation by dissolving it in crystal spring water at a concentration of from about 0.05 to 0.1 ppm. The obtained beverage possessed an earthy woody taste, reminiscent of the taste conferred by patchouli oil.

What is claimed is:

1. A process for enhancing, improving or modifying the fragrance properties of perfumes and perfumed products which comprises the step of admixing 1-ethynyl-2,2,6-trimethyl-cyclohexanol in said perfumes or perfumed products.

2. A process for enhancing, improving or modifying the woody scent of perfume compositions which comprises adding thereto a fragrance effective amount of 1-ethynyl-2,2,6-trimethyl-cyclohexanol.

3. A perfume composition which comprises as an effective fragrance-modifying ingredient 1-ethynyl-2,2,6-trimethyl-cyclohexanol.

4. A flavour composition which comprises as active ingredient 1-ethynyl-2,2,6-trimethyl-cyclohexanol.

* * * * *

UNITED STATES PATENT AND TRADEMARK OFFICE

CERTIFICATE OF CORRECTION

PATENT NO. : 4,261,867

DATED : April 14, 1981

INVENTOR(S) : Peter Fankhauser, et al.

It is certified that error appears in the above-identified patent and that said Letters Patent are hereby corrected as shown below:

On the title page, first column, under Foreign Application Priority Data: "Feb. 2, 1979" should read as --Feb. 5, 1979--.

Signed and Sealed this

*Twenty-first* Day of *May 1985*

[SEAL]

*Attest:*

DONALD J. QUIGG

*Attesting Officer*

*Acting Commissioner of Patents and Trademarks*